United States Patent [19]

Ortiz, Jr.

[11] 4,054,146

[45] Oct. 18, 1977

[54] CIGARETTE PERFORATER BOX

[75] Inventor: Jaime Ortiz, Jr., Bronx, N.Y.

[73] Assignee: Lawrence Peska Assoc., New York, N.Y.

[21] Appl. No.: 606,234

[22] Filed: Aug. 20, 1975

[51] Int. Cl.[2] ..... A24F 13/00

[52] U.S. Cl. ..... 131/170 R; 206/236

[58] Field of Search ..... 131/170, 83, 254, 188, 131/233, 250, 253; 206/86, 236, 238; 144/2 J, 2 K, 30

[56] References Cited

U.S. PATENT DOCUMENTS

| | | | |
|---|---|---|---|
| 1,125,598 | 1/1915 | Sebastiani | 131/254 X |
| 2,382,221 | 8/1945 | Groth | 111/99 |
| 2,694,399 | 11/1954 | Parker | 131/170 R |
| 2,854,010 | 9/1958 | Stamm | 131/170 R |
| 3,080,872 | 3/1963 | Granacher | 131/170 R |
| 3,483,873 | 12/1969 | Hinzman | 131/170 X |

*Primary Examiner*—Stephen C. Pellegrino

[57] ABSTRACT

In order to reduce the content of smoking byproducts (including nicotine and tars) in the smoke inhaled by the smoker, the disclosed perforator box is used to simultaneously perforate the paper, covering the smoking end of all cigarettes in a pack. To accomplish this, the full pack is placed in the open sided box and a needle studded cover is pressed onto the box so that the neeldes perforate the cigarettes. When smoked, smoke from the perforated cigarettes contains a lower percentage of nicotine and tars. It is suggested that this should aid a person desirous of stopping to achieve his goal.

1 Claim, 3 Drawing Figures

CIGARETTE PERFORATER BOX

BACKGROUND OF THE INVENTION

This invention concerns equipment which is accessory to the smoking of cigarettes.

The cigarette art contains many references to cigarettes made with perforated paper U.S. Pat. No. 3,046,994, issued July 31, 1962) or ventilation flaps (U.S. Pat. No.3,739,785, issued June 19, 1973) in order to dilute the inhaled smoke and/or reduce the burning temperature of the cigarette. However, in order to benefit from such an invention, the smoker is limited to the cigarette brands which are so constructed.

SUMMARY OF THE INVENTION

A cigarette perforating device has been developed, which enables all the cigarettes in a pack to be simultaneously perforated. Thus, a smoker desiring to smoke a ventilated cigarette, is free to choose the cigarette brand he prefers. The inventive device is a perforater box. The pack of cigarettes is placed in box with an open broad face. A box cover is provided which is studded with needle shaped members. When the lid is pressed down onto the open box, the needle shaped members pierce the cigarettes to provide ventilation.

DETAILED DESCRIPTION OF THE INVENTION

Figure 1:
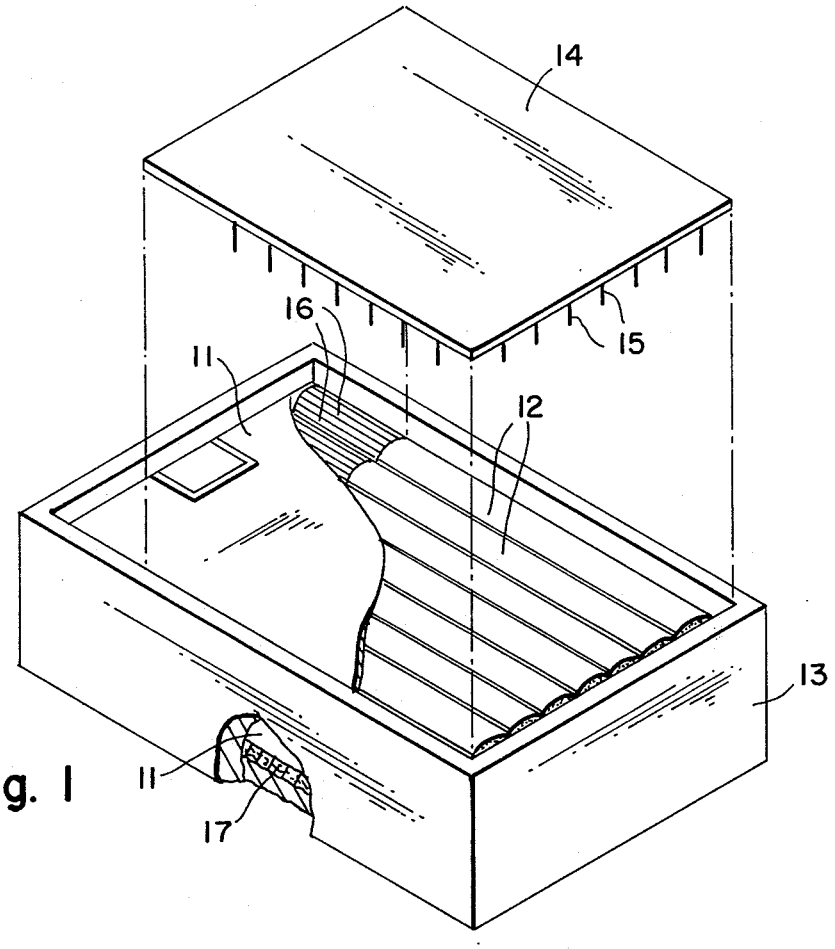
FIG. 1 is a perspective view of an exemplary device of the claimed invention.
Figure 2:
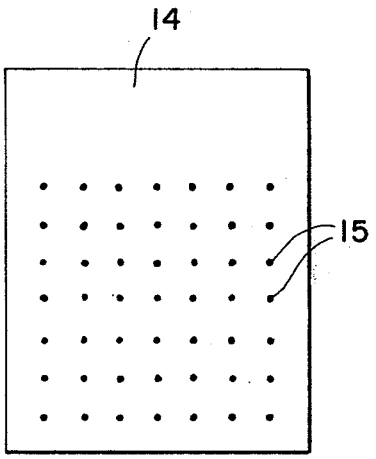
FIG. 2 is a plan view of the studded side of the box lid.

The disclosed cigarette perforater box, which may be called a "Slow Smoke Needle Box," serves to place ventilating holes simultaneously in all the cigarettes of a pack. Its operation can be understood by reference to FIG. 1. In operation, a pack 11 of cigarettes 12 is placed in a rectangular parallelapiped box 13 which is open at one broad face. A lid 14 which is adapted to fit the box 13 is studded on its inward facing surface, with parallel needle-like members 15. These members are sharp enough to pierce the cigarette pack 11 and the cigarettes 12. The members 15 are arranged (see FIG. 2) so that all cigarettes in the pack 11 are perforated. The members 15 are distributed approximately uniformly over a portion of the cover 14 corresponding to a major portion of the smokable or combustable end of the cigarette 12. It is preferrable to avoid perforating the upper region of the cigarette 12, particularly since many cigarettes are equipped with filters 16.

The inside face of the box 13 opposite the open broad face is preferrably covered by a thin resilient pad 17 of, perhaps, felt or foam plastic. This insures that the members 15 will be able to pass through the bottom cigarettes, without the necessity of applying inordinately large pressure on the lid 14. This avoids damage to the piercing members 15.

Figure 3:
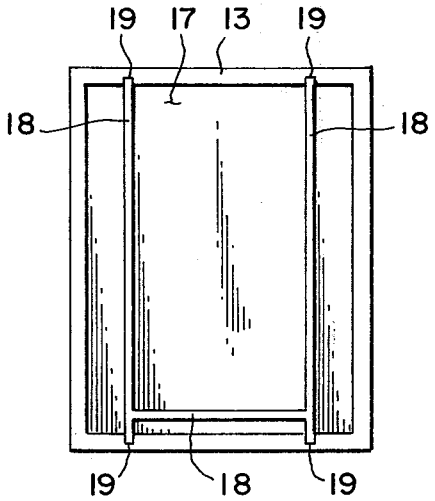
FIG. 3 is a plan view of open broad side of an exemplary box of the invention, showing the placement of spacers.

Since it is preferrable that the cigarette pack 11 fit snugly in the box 13, either a different box should be available to fit all standard cigarette packs or a set of spacers 18 (see FIG. 3) can be provided. These spacers 18 can, for example be adapted to fit into slots 19 in the side walls of the box 13. They must be positioned so as not to interfere with the piercing members 15. The box 13 is then at least as large as the largest standard pack 11 and a spacer can be provided to snugly fit other, smaller packs.

I claim

1. A device for perforating cigarettes comprising a rectangular parallelapiped shaped box with one open broad face, the box being dimensioned to accomodate a pack of cigarettes, a rectangular cover, fitting the open broad face and a plurality of needle shaped members affixed to the inward facing surface of cover, the members being parallel to one another and distributed approximately uniformly over a portion of the cover corresponding to a major portion of the combustable end of the cigarettes which the box is to hold, said box including a thin resilient pad covering the inner face of box face opposite to the open broad face.

* * * * *